US011066827B2

(12) United States Patent
Daysh

(10) Patent No.: US 11,066,827 B2
(45) Date of Patent: Jul. 20, 2021

(54) PRECISION DRY-STACK MASONRY UNIT

(71) Applicant: Daysh Developments, Inc., Benicia, CA (US)

(72) Inventor: Paul Daysh, Concord, CA (US)

(73) Assignee: Daysh Developments, Inc., Benicia, CA (US)

( * ) Notice: Subject to any disclaimer, the term of this patent is extended or adjusted under 35 U.S.C. 154(b) by 0 days.

(21) Appl. No.: 16/516,159

(22) Filed: Jul. 18, 2019

(65) Prior Publication Data

US 2019/0338514 A1 Nov. 7, 2019

Related U.S. Application Data

(63) Continuation-in-part of application No. 29/640,572, filed on Mar. 15, 2018, now Pat. No. Des. 854,709.

(60) Provisional application No. 62/700,765, filed on Jul. 19, 2018.

(51) Int. Cl.

| | |
|---|---|
| ***E04B 2/46*** | (2006.01) |
| ***E04B 2/02*** | (2006.01) |
| ***E04B 1/84*** | (2006.01) |

(52) U.S. Cl.

CPC ..... *E04B 2/46* (2013.01); *E04B 1/8404* (2013.01); *E04B 2001/849* (2013.01); *E04B 2002/0206* (2013.01)

(58) Field of Classification Search

CPC ..... E04B 2/42; E04B 2/52; E04B 2/54; E04B 2001/849; E04B 2002/0206; E04B 1/8404

See application file for complete search history.

(56) References Cited

U.S. PATENT DOCUMENTS

| | | | | |
|---|---|---|---|---|
| 2,191,217 | A * | 2/1940 | Liebowitz | E04B 2/42 52/600 |
| 2,530,940 | A * | 11/1950 | Dahlin | E04B 1/703 454/185 |
| 2,684,589 | A * | 7/1954 | Perreton | E04B 2/42 52/591.2 |
| 5,913,791 | A * | 6/1999 | Baldwin | E04B 2/42 52/422 |
| 8,549,811 | B2 | 10/2013 | Dyson | |
| 8,820,024 | B1 * | 9/2014 | Abdullah | E04B 2/08 52/605 |
| 10,415,241 | B2 * | 9/2019 | Simonson | E04B 2/32 |
| 10,472,822 | B1 * | 11/2019 | Castro | E04B 2/38 |
| 2007/0151191 | A1 * | 7/2007 | August | E04B 2/54 52/604 |

(Continued)

FOREIGN PATENT DOCUMENTS

| | | | | |
|---|---|---|---|---|
| DE | 880930 C | * | 6/1953 | E04B 2/42 |
| FR | 2486984 A1 | * | 1/1982 | E04B 2/42 |
| FR | 2512090 A1 | * | 3/1983 | E04B 2/42 |

*Primary Examiner* — Christine T Cajilig

(74) *Attorney, Agent, or Firm* — Brian Beverly; Beeson Skinner Beverly, LLP

(57) ABSTRACT

The present invention generally relates to a precision dry-stack masonry unit made of two spaced-apart face shells and at least one connector joining the face shells. The connector has a top surface, a right surface and a left surface. The top surface of the connector and the face shells form a horizontal channel above the connector, and the right surface and the left surface of the connector and the face shells form vertical channels to each side of the connector. Each of the channels is configured to accommodate one or more reinforcement bars.

14 Claims, 7 Drawing Sheets

(56) References Cited

U.S. PATENT DOCUMENTS

| | | | |
|---|---|---|---|
| 2014/0059962 | A1 | 3/2014 | O'Connor |
| 2016/0024784 | A1 | 1/2016 | Farrell |

* cited by examiner

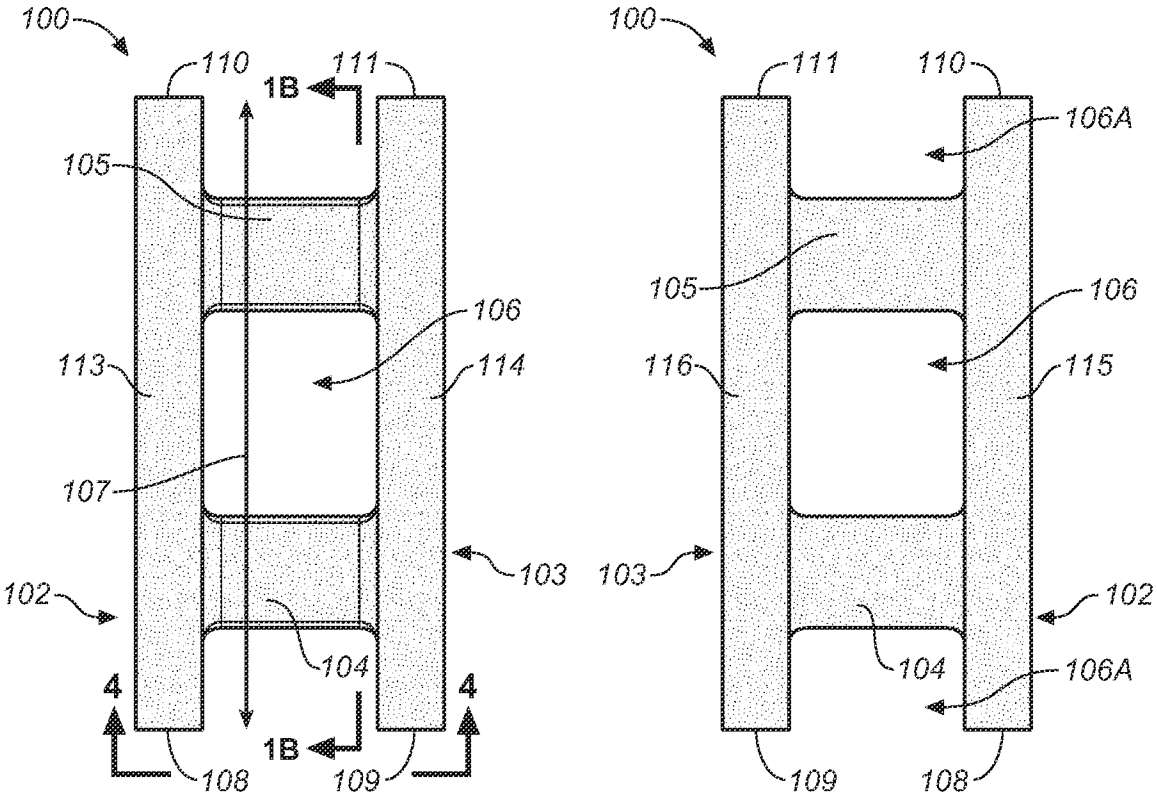
FIG. 2
FIG. 3
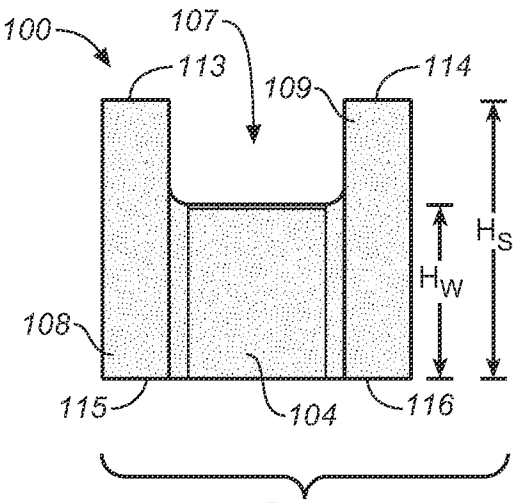
FIG. 4

PRECISION DRY-STACK MASONRY UNIT

CROSS-REFERENCE TO RELATED APPLICATIONS

This application is a continuation-in-part of U.S. Design patent application Ser. No. 29/640,572, filed Mar. 15, 2018, and further claims the benefit of U.S. Provisional Application No. 62/700,765, filed Jul. 19, 2018, the entire contents of which are incorporated herein by reference.

BACKGROUND

Field of the Invention

The present invention generally relates to construction materials and, more particularly, relates to a precision dry-stack masonry block for use in building structures, retaining walls and sound walls and a method of constructing a wall using the same.

Summary of the Invention

In one embodiment of the invention, a dry-stack masonry block comprises two spaced-apart face shells connected by one or more interior connectors to form one or more vertical channels. The connectors extend from the bottom of the connected face shells to a height less than the that of the face shells to form a horizontal channel at the top of the block.

A wall is constructed by stacking horizontal rows of the blocks with every other row inverted so that the horizontal channels of the blocks in each such inverted row meet with the horizontal channels of the upright blocks of the row below it. The horizontal and vertical channels of the stacked rows of masonry blocks intersect to form a hollow interior grid which can be filled with grout. Since the halves of each masonry block are horizontally symmetrical, the blocks of each row can be horizontally offset from the blocks of the row immediately below it and still form the hollow grid mentioned above.

The dry-stack masonry block of the invention can be cast using less material than prior art blocks, resulting in a lighter, more affordable block, and the stacked configuration allows for more robust bar reinforcement and overall wall strength and eliminates the need for grade beam footings. The invention also enjoys the benefits of a mortar-less masonry wall system, including elimination of the need for transporting, mixing and troweling mortar.

BRIEF DESCRIPTION OF THE DRAWINGS

Exemplary embodiments of the invention will now be described with reference to the accompanying drawings, in which:

FIG. 2 is a top plan view thereof.

FIG. 3 is a bottom plan view thereof.

FIG. 4 is a side elevational view thereof taken along line 4 of FIG. 2, the other side elevation view being a mirror image of FIG. 4.

DETAILED DESCRIPTION OF THE ILLUSTRATED EMBODIMENTS

The Masonry Unit

FIGS. 1 to 4 show a dry-stack masonry block 100 according to the invention. Block 100 is made of two face shells 102 and 103 connected by two interior connectors 104 and 105 to form a double open-ended bond beam masonry block having a vertical center channel 106 and vertical end channels 106A.

Figure 1A:
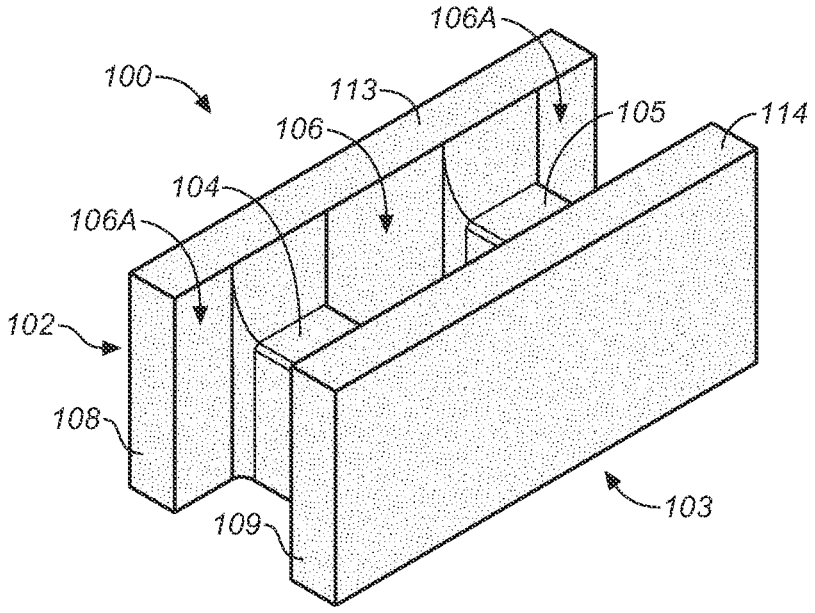
FIG. 1A is a perspective view of a dry-stack masonry block according to the invention.
Figure 1B:
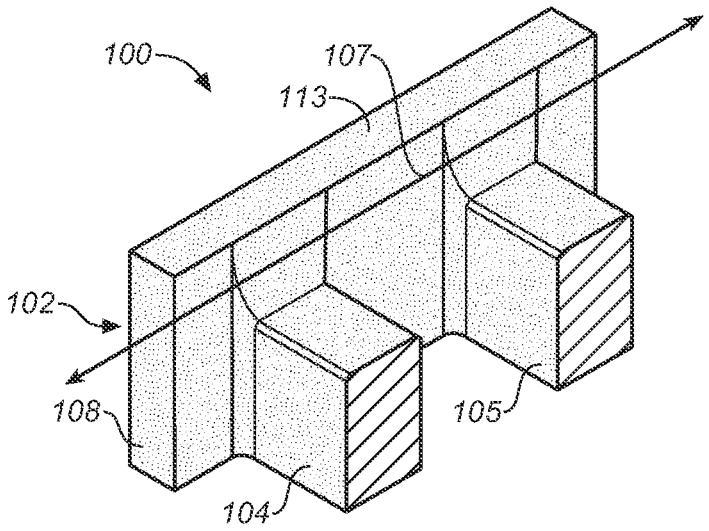
FIG. 1B is a sectional perspective view thereof, taken along line 1B of FIG. 2.

FIG. 1A is a perspective view of block 100, and FIG. 1B is a sectional perspective view of the block 100 that more clearly shows interior connectors 104 and 105. FIGS. 2 and 3 show top plan and bottom plan views of block 100 respectively.

Face shell 102 has a free edge 113 on the topside thereof, a connector edge 115 on the bottom side and side edges 108 and 110. Face shell 103 has a topside free edge 114, a bottom side connector edge 116 and side edges 109 and 111.

Interior connectors 104 and 105 have a height $H_w$ that extends from the bottom of face shells 102 and 103 to less than the full height $H_s$ of face shells 102 and 103. As described in detail below with respect to FIGS. 8 and 9, the shortened height $H_w$ of interior connectors 102 and 103 forms a horizontal channel 107 at the top of block 100.

The measurements and proportions of block 100 can vary depending on the particular requirements of a building project. In one embodiment, face shells 102 and 103 are of identical shape and proportion with the height $H_s$ of the face shells (i.e., the length of side edges 108, 109, 110 and 111) being approximately 8 inches, the length of the face shells (i.e., the length of top and bottom edges 113, 114, 115 and 116) being approximately 18 inches, and the width of the face shells being approximately 2 inches. In the same embodiment, interior webs 104 and 105 are also of identical shape and proportion, with the height $H_w$ of the webs being approximately 5.5 inches, the length of the webs being approximately 3 inches and the width of the interior webs (i.e., the spacing between the interconnected face shells) being approximately 5 inches, giving block 100 approximate overall dimensions of 8 inches by 9 inches by 18 inches (typical dimensions used in the construction industry). It should be understood, however, that this is just one exemplary set of dimensions for block 100.

Block 100 can be made of cast concrete (e.g., Portland cement and aggregate, such as sand or fine gravel), or can be made of a lower density building material such as fly ash or bottom ash (as in a cinder block) or foam concrete (e.g., autoclaved aerated concrete). The block 100 can also be formed of any other alternative building materials and/or can be formulated with special aggregates to produce desired coloring or texture.

Method of Constructing Wythe Using the Masonry Block

FIGS. 5 to 9 illustrate a method of dry-stacking a plurality of masonry blocks according to the invention in order to construct a wythe 300 that can form all or a portion of a wall, such as, for example, a retaining wall, a sound wall, a veneer, or the wall of a building structure.

In the illustrated stacking method, horizontal rows of blocks 100 are stacked one on top of another with the vertical orientation of the blocks alternating between each stacked row (i.e., in a running bond configuration). The blocks can also suitably be arranged in a stack bond configuration.

Figure 5:
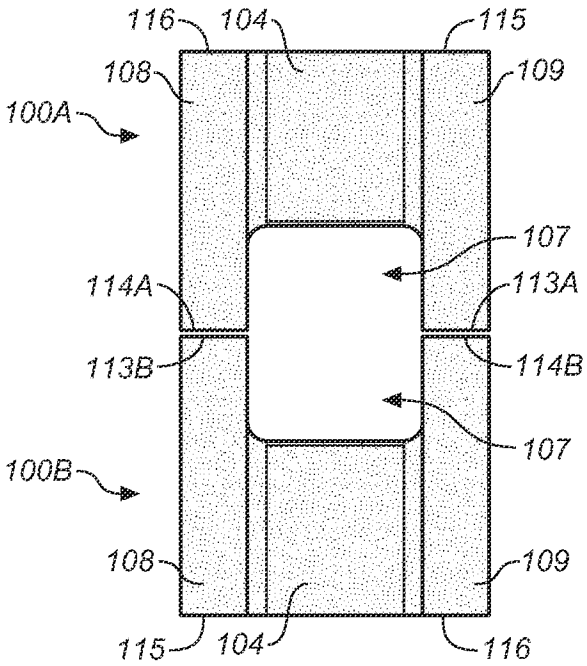
FIG. 5 is a side elevational view of two blocks in accordance with the invention stacked one on top of the other in opposite vertical orientations, as would be done in the construction of a wythe using the blocks.
Figure 7:
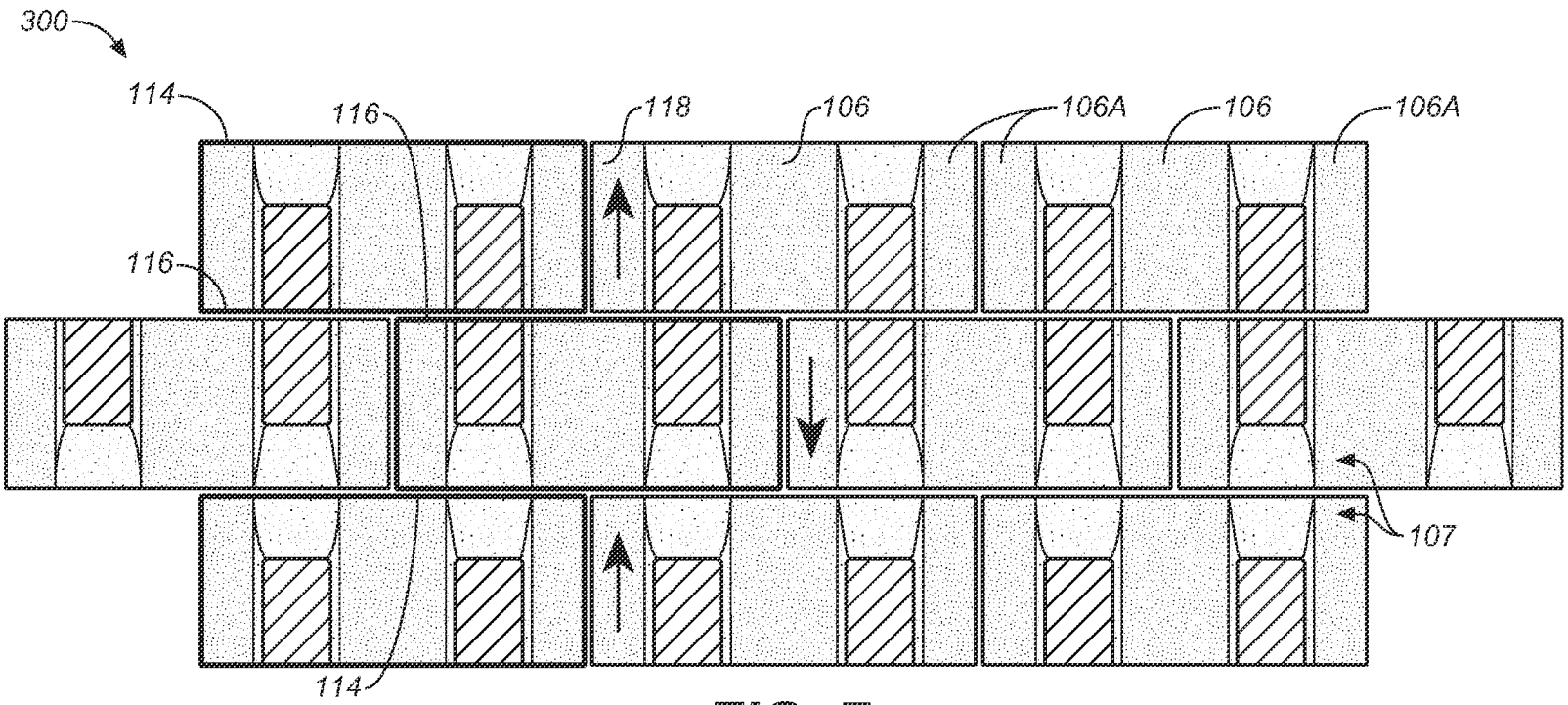
FIG. 7 is a front elevation view of a partially constructed wythe including three horizontal rows of blocks according to the invention stacked one on top of the other and horizontally offset from one another, with the vertical orientation of the blocks alternating between each row in accordance with the stacking method illustrated in FIGS. 5 and 6.

FIG. 5 shows a side elevation view of a wythe made of a bottom row of masonry blocks and a top row of masonry blocks. Bottom block 100B is shown with an upright vertical orientation with top block 100A positioned upside down on top of bottom block 100B, such that the free edges 113B and 114B of bottom block 100B roughly align with and support the free edges 114A and 113A of top block 100A respectively, such that the horizontal 107 and vertical 106, 106A channels converge to form a hollow internal grid. The bottom row of block 100B and the top row of block 100A are also staggered horizontally in a running bond configuration, as shown in FIG. 7.

Construction of the wythe continues by placing a third row of masonry blocks in an upright position on top of the inverted row of blocks in the second row. As seen, this extends the vertical channels 106, 106A and sets up the horizontal channel 107 of the third row to meet the horizontal channel of a fourth row (not shown) to further establish the grid.

Figure 6:
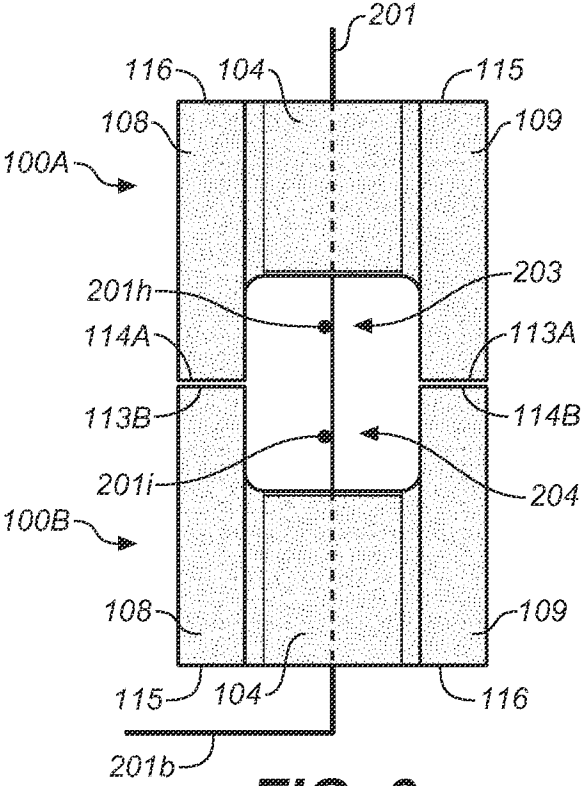
FIG. 6 is a side elevational view, again showing two blocks in accordance with the invention stacked one on top of the other and illustrating the manner in which vertical and horizontal reinforcement bars would be used in the construction of a wythe using the blocks.
Figure 8:
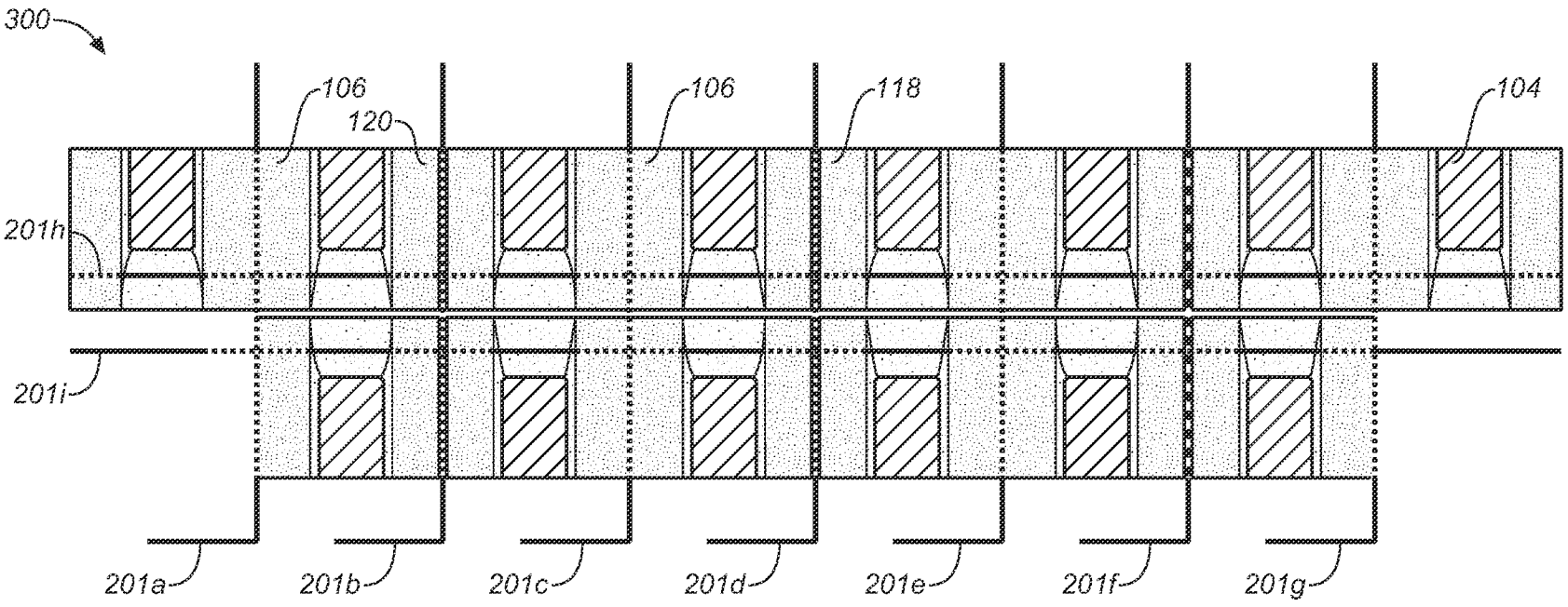
FIG. 8 is a front elevation view of a partially constructed wythe illustrating the manner in which vertical and horizontal reinforcement bars are housed within the interior grid of channels formed by the interlacing vertical cores and horizontal channels of the stacked blocks.
Figure 9:
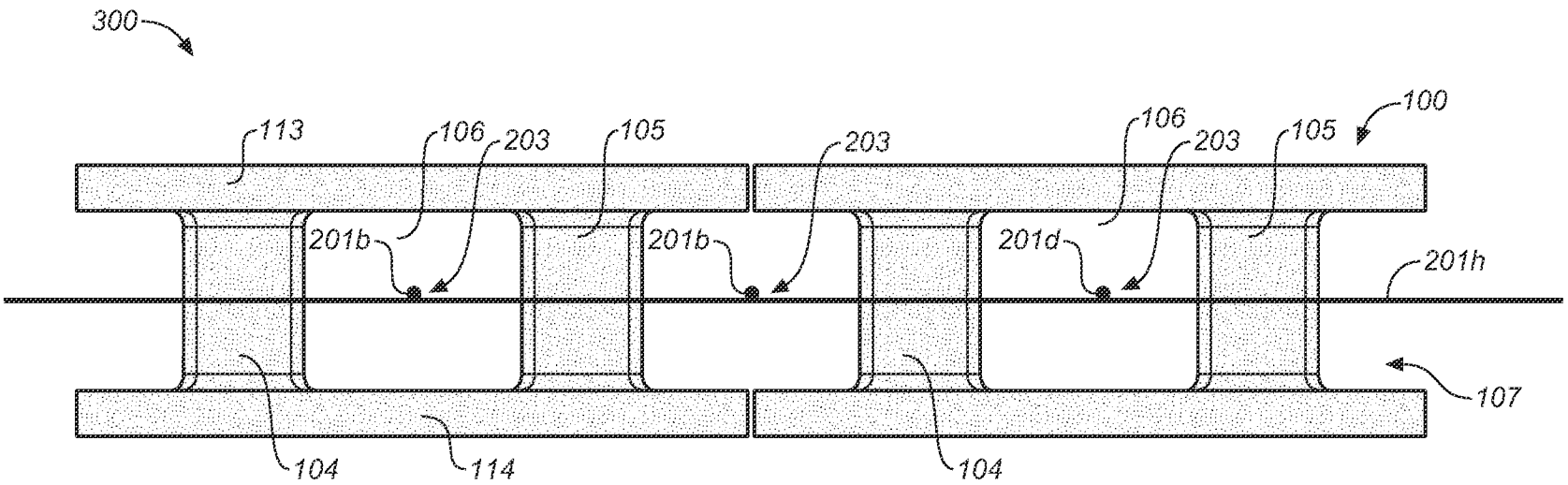
FIG. 9 is a top plan view of a partially constructed wythe made of masonry blocks according to the invention.

As shown in FIG. 8, one or more vertical reinforcement bars 201*a* to 201*g* are fed through each vertical channel and one or more horizontal reinforcement bars 201*h* and 201*i* are fed through each horizontal channel. FIGS. 6 and 8 show that the vertical and horizontal reinforcement bars can be interlocked at points 203 and 204 to form a mesh. The horizontal and vertical channels are filled with grout which, when hardened, secures the reinforcement bars in place forming a grid of internal horizontal and vertical interlocking beams within the wythe.

Figure 10:
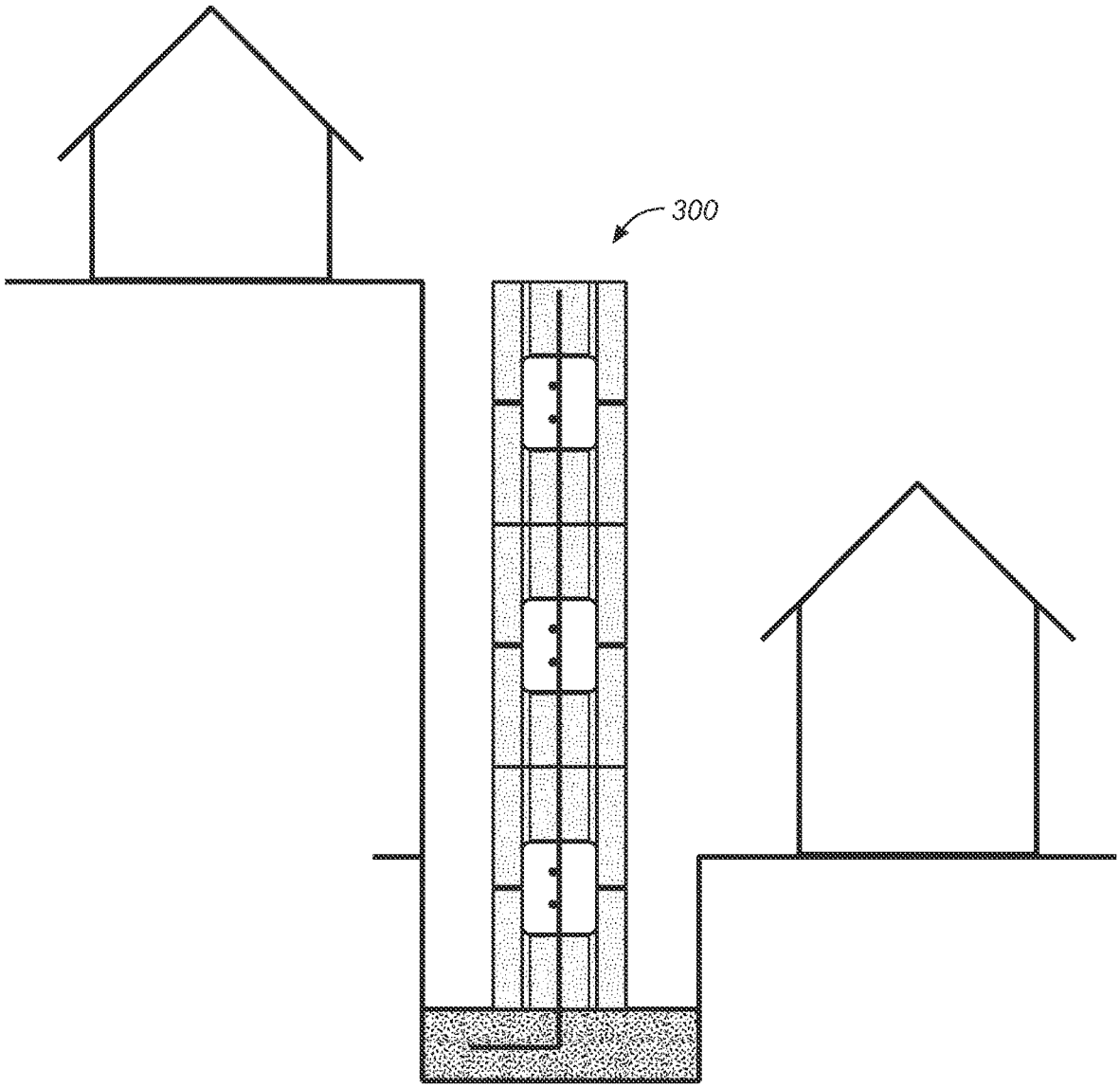
FIG. 10 is a side elevation view of a retaining wall constructed with masonry blocks according to the invention.

FIG. 10 is a side elevation view of a retaining wall made from a wythe 300 constructed with masonry blocks according to the invention. The illustrated retaining wall serves as a lot line wall separating two lots of land having different elevations.

The masonry blocks, when stacked as discussed above, result in a sturdy wall structure that is robustly reinforced by the vertical and horizontal web of bars. Additionally, the needs for grade beam footings and for transporting, mixing and troweling mortar are eliminated.

Exemplary embodiments of the invention have thus been described and illustrated herein in detail. These embodiments are merely example implementations of the invention and are not to be taken as limiting, the spirit and scope of the invention being limited only by the terms of the appended claims and their legal equivalents. Alternative embodiments of the invention not expressly disclosed herein will be evident to persons of ordinary skill in the art.

What I claim is:

1. A masonry wall comprising:

a first row of a plurality of masonry blocks disposed in an upright orientation, each block having:

two spaced-apart face shells, each shell having a connector edge and a free edge vertically opposite the connector edge, and at least one connector joining the face shells, the connector having a top surface, a bottom surface, a right surface and a left surface, the bottom surface of said connector coplanar with the connector edge of the face shells, the top surface of the connector and the face shells forming a horizontal channel, and each of the right and left surfaces of the at least one connector and the face shells forming a vertical channel, a second row of the masonry blocks disposed on top of the first row in an upside-down orientation such that the horizontal and vertical channels of the blocks of the first and second rows meet to form a hollow grid, grout disposed in the grid bonding the masonry blocks together to form a wall.

2. The wall of claim 1, wherein the face shells of each block are oriented parallel to one another.

3. The wall of claim 1, wherein the face shells of each block are a rectangular cuboid shape.

4. The wall of claim 1, wherein the blocks are made of at least one of cast concrete, foam concrete, fly ash, bottom ash, sand or gravel.

5. The wall of claim 1, wherein the face shells of each of the plurality of blocks are of approximately identical shape and proportion.

6. The wall of claim 1, wherein said at least one connector comprises two connectors.

7. A method of constructing a wall comprising:

laying a first row of masonry blocks in an upright orientation, each of the blocks having:

two spaced-apart face shells, each shell having a connector edge and a free edge vertically opposite the connector edge, at least one connector joining the face shells, each connector having a top surface, a bottom surface, and right and left side surfaces extending between the top and bottom surfaces, the bottom surface of said connector coplanar with the connector edge of the face shells, the top surface of the at least one connector and the face shells forming a horizontal channel, and each of the right and left side surfaces of the connector and the face shells forming a vertical channel, laying a second row of masonry blocks in an inverted orientation on top of the first row, the free edge of the face shells of the first row of masonry blocks engaging and supporting the free edge of the face shells of the inverted masonry blocks of the second shell, such that the horizontal and vertical channels of the first and second rows of blocks meet to form a hollow grid, laying a third row of masonry blocks in the upright orientation on top of the second row of masonry blocks, the connector edges of the face shells and the bottom surfaces of the connectors, respectively, of the second row of inverted blocks engaging and supporting the connector edges of the face shells and the bottom surfaces of the connectors, respectively, of the third row of blocks, such that the vertical channels of the second and third rows of blocks meet thereby the hollow from the first and second rows of blocks into the third row of blocks, filling the grid with grout to bond the blocks of the first, second and third rows of masonry blocks together to form a wall.

8. The method of constructing a wall of claim 7, wherein:

each connector having a thickness, and the length of the face shells is approximately six times the thickness of the connector.

9. The method of constructing a wall of claim 8, wherein:

the thickness of each connector is approximately three inches.

10. The method of constructing a wall of claim 7 comprising:

placing a reinforcement bar in at least one of the horizontal openings and in at least one of the vertical openings before filling the network with grout.

11. The method of constructing a wall of claim 10 comprising:

interlocking the horizontal and vertical reinforcement bars to form a mesh in the grid.

12. The method of constructing a wall of claim 7, wherein the face shells of each block are oriented parallel to one another.

13. The method of constructing a wall of claim 7, wherein the face shells of each block are a rectangular cuboid shape.

14. The method of constructing a wall of claim 7, wherein the blocks are made of at least one of the group consisting of cast concrete, foam concrete, fly ash, bottom ash, sand and gravel.

* * * * *